US009408457B2

(12) United States Patent
Debnam

(10) Patent No.: US 9,408,457 B2
(45) Date of Patent: Aug. 9, 2016

(54) HANDS-FREE BAG CARRYING DEVICE

(71) Applicant: Antwaine Debnam, Hartford, CT (US)

(72) Inventor: Antwaine Debnam, Hartford, CT (US)

(73) Assignee: Antwaine Debnam, Hartford, CT (US)

( * ) Notice: Subject to any disclaimer, the term of this patent is extended or adjusted under 35 U.S.C. 154(b) by 0 days.

(21) Appl. No.: 14/751,229

(22) Filed: Jun. 26, 2015

(65) Prior Publication Data

US 2015/0366331 A1 Dec. 24, 2015

Related U.S. Application Data

(63) Continuation-in-part of application No. 13/912,794, filed on Jun. 7, 2013, now abandoned.

(51) Int. Cl.

| | |
|---|---|
| ***A45F 3/10*** | (2006.01) |
| ***A45F 5/10*** | (2006.01) |
| ***A45F 3/14*** | (2006.01) |

(52) U.S. Cl.

CPC . *A45F 5/102* (2013.01); *A45F 3/14* (2013.01); *A45F 5/1026* (2013.01); *A45F 2003/142* (2013.01)

(58) Field of Classification Search

CPC ..... A45F 3/02; A45F 3/10; A45F 2003/003
See application file for complete search history.

(56) References Cited

U.S. PATENT DOCUMENTS

| | | | | | |
|---|---|---|---|---|---|
| 2,132,556 | A | | 10/1938 | Blackshaw | |
| 4,091,974 | A | | 5/1978 | McClintock | |
| 4,119,249 | A | * | 10/1978 | Hanson | A45C 11/00 224/236 |
| 4,324,205 | A | | 4/1982 | Goldmacher | |
| 4,402,440 | A | | 9/1983 | Purtzer et al. | |
| 4,420,104 | A | * | 12/1983 | Dilenno | A45F 5/021 224/250 |
| 4,480,775 | A | | 11/1984 | Stanford | |
| 5,044,538 | A | * | 9/1991 | Bader | A45F 3/14 224/250 |
| 5,158,332 | A | | 10/1992 | Goulter et al. | |
| 5,178,309 | A | | 1/1993 | Bicheler et al. | |
| 5,267,680 | A | * | 12/1993 | Torok | A47D 13/02 224/158 |
| 5,437,403 | A | * | 8/1995 | Lemanski, II | A45F 3/02 224/603 |
| 5,439,154 | A | * | 8/1995 | Delligatti | A45C 9/00 150/106 |
| 5,497,923 | A | | 3/1996 | Pearson et al. | |
| 5,669,170 | A | * | 9/1997 | Norris | F41C 33/00 224/150 |
| 5,690,261 | A | * | 11/1997 | Moore | A45F 3/14 206/278 |
| 5,695,101 | A | | 12/1997 | Frietze | |
| 5,775,495 | A | | 7/1998 | Lang | |
| 6,179,175 | B1 | | 1/2001 | Painter | |
| 6,267,277 | B1 | * | 7/2001 | Taylor | A45C 7/0095 206/350 |
| 6,311,884 | B1 | | 11/2001 | Johnson | |
| 6,533,150 | B1 | * | 3/2003 | Margo | A45F 5/021 224/148.1 |
| 6,832,711 | B2 | | 12/2004 | Black | |
| 8,062,194 | B2 | | 11/2011 | Weiss | |
| 8,225,973 | B1 | | 7/2012 | Bellinson | |
| 8,496,143 | B1 | | 7/2013 | Joseph | |
| 8,690,035 | B2 | | 4/2014 | Silverman | |
| 2001/0040177 | A1 | * | 11/2001 | Hammond | A45B 11/02 224/188 |
| 2002/0148866 | A1 | | 10/2002 | Dent, III | |
| 2006/0113344 | A1 | * | 6/2006 | Cragg | A45F 5/02 224/579 |

(Continued)

*Primary Examiner* — Brian D Nash
(74) *Attorney, Agent, or Firm* — Bachman & LaPointe, P.C.

(57) ABSTRACT

A hands-free bag carrying device is used to carry articles, such as bags, umbrellas, jackets and the like, without the use of a user's hands. The device secures snuggly around the user's torso and allows for optimal leveraging of the baggage load so that there is minimal interference with the normal walking stride of the user. The device also prevents the baggage from rubbing the legs of the user.

7 Claims, 6 Drawing Sheets

(56) References Cited

U.S. PATENT DOCUMENTS

| | | | | |
|---|---|---|---|---|
| 2006/0157525 | A1 | 7/2006 | Furlong et al. | |
| 2006/0289575 | A1 | 12/2006 | Chou | |
| 2007/0090143 | A1 | 4/2007 | Clayton, III et al. | |
| 2007/0108241 | A1 | 5/2007 | Bass et al. | |
| 2008/0156834 | A1 | 7/2008 | Tipaldo | |
| 2009/0014483 | A1* | 1/2009 | Green | A41D 13/0007 224/157 |
| 2011/0006090 | A1 | 1/2011 | Bollard | |
| 2013/0233902 | A1 | 9/2013 | Henry et al. | |
| 2015/0189977 | A1* | 7/2015 | Thompson | A45F 5/02 24/3.7 |

* cited by examiner

HANDS-FREE BAG CARRYING DEVICE

CROSS REFERENCE TO RELATED APPLICATION

This application is a continuation-in-part and claims the benefit of application Ser. No. 13/912,794, filed Jun. 7, 2013 and entitled HANDS-FREE BAG CARRYING DEVICE.

BACKGROUND

The present disclosure is directed to a hands-free bag carrying device. More particularly, the embodiments disclosed herein allow a user to carry multiple bags, umbrellas, jackets and similar articles without using hands to grasp them. This makes carrying multiple articles during travel or every day commuting easier and more convenient.

During travel or commuting, it is often necessary to transport multiple items, including bags, bags, umbrellas, jackets and similar associated articles. Typically, a traveler carries a number of items by hand, which makes walking less balanced, and travel more burdensome and less pleasurable. An attempt to distribute the weight evenly between both hands may alleviate the problem somewhat but does not free the hands and could make walking with the load even slower, leading to shorter footsteps and a penguin like sway. Conventional products which seek to assist the traveler by freeing up the hands neither alleviate the problem of the baggage rubbing against the legs of the user, which hinders the normal walking pattern of the user, nor do such devices optimally leverage the weight of the baggage.

It is desirable to have a bag carrying device which allows the transport of baggage while freeing up a traveler's hands. It is further desirable that the device does not interfere with the normal walking pace or walking manner of the user by optimally leveraging the load and preventing the baggage from rubbing against the legs of the user. It is also desirable that the hands-free device maintains a comfortable feel during periods of extended use and provides a mode of transporting baggage designed to closely mimic how people would have multiple bags draped on themselves. There exists a need in the art to overcome the deficiencies and limitations described herein and above.

SUMMARY

In accordance with the present disclosure, there is provided a hands-free bag carrying device comprising a contoured saddle, the contoured saddle comprises a base, the base comprises an integrally formed sheet of rigid material having a curved cross-section. A front panel is attached to the base. The front panel comprises an integrally formed sheet of rigid material. A back panel is attached to the base, the back panel comprises an integrally formed sheet of rigid material. A plurality of hooks are attached to the base. A strap is attachable to the contoured saddle proximate the front panel and the back panel.

In another and alternative embodiment, the strap is configured to fit over a shoulder of a user and the strap being configured to locate the contoured saddle on a side of the user opposite to the location of the strap over the shoulder.

In another and alternative embodiment, the contoured saddle is configured to fit along a torso at a side of a user.

In another and alternative embodiment, at least one of a clamp and a barrette is embedded into the front panel on a side opposite the plurality of hooks.

In another and alternative embodiment, the base is centrally located in relation to the front panel and the back panel.

In another and alternative embodiment, the base is elevated in relation to the front panel and the back panel, and configured to provide a clearance space away from a user's legs with relation to an article suspended from the base.

In another and alternative embodiment, at least one clamp is attached to the back panel. The at least one clamp is configured to attach the carrying device to a strap of a separate bag.

In accordance with the present disclosure, there is provided a system for carrying articles, such as bags, the system comprises a saddle. The saddle comprises a base configured as at least one integral panel, each of the at least one panels comprises an integrally formed sheet of rigid material. At least one hook is coupled to at least one panel. The at least one hook is configured to support the article attached thereto. A strap is coupled to the base, the strap being configured to support the saddle and fit over a shoulder of a user, the shoulder being opposite a side of the user's torso proximate the saddle.

In another and alternative embodiment, the at least one integral panel comprises a plurality of panels rotatably coupled to each other.

In another and alternative embodiment, the plurality of panels are hinged together and configured to fold onto each other such that at least one hook stows into at least one cavity.

In another and alternative embodiment, the strap comprises a tab configured to support a strap of another bag proximate the shoulder of the user.

In another and alternative embodiment, the base is configured in a curved shape to elevate distally from the torso of the user, and configured to provide a clearance space away from a user's legs with relation to an article suspended from the base.

In another and alternative embodiment, at least one clamp attached to the at least one panel; the at least one clamp configured to attach the saddle to a strap of a separate bag.

In accordance with the present disclosure, there is provided a method of carrying articles hands-free comprises donning a hands-free carrying device; the device comprises a contoured saddle. The saddle comprises a base, the base comprises an integrally formed sheet of rigid material having a curved cross-section. A front panel is attached to the base, the front panel comprises an integrally formed sheet of rigid material. A back panel is attached to the base, the back panel comprises an integrally formed sheet of rigid material. A plurality of hooks are attached to the base. A strap is attachable to the contoured saddle proximate the front panel and the back panel. The method includes attaching at least one article to one of the plurality of hooks. The method includes carrying the device.

In another and alternative embodiment, the donning step comprises placing the strap over a shoulder of a user; and placing the base, the front panel and the back panel to fit firmly along the torso proximate the side of the user opposite from the shoulder, wherein the front panel is proximate the front of the torso and the back panel is proximate the back of the torso.

In another and alternative embodiment, the method includes providing a clearance space away from a user's legs with relation to the article suspended from the base, wherein the base is configured in a curved shape to elevate distally from the torso of the user.

In another and alternative embodiment, the method includes attaching the saddle to a strap of a separate bag by deploying at least one clamp attached to the back panel.

In another and alternative embodiment, the method includes supporting a strap of another bag proximate the shoulder of the user by deploying a tab coupled to the strap.

In another and alternative embodiment, the method includes attaching another article to the saddle on at least one of a clamp and a barrette embedded into the front panel on a side opposite the plurality of hooks.

The shortcomings of the past technology is overcome and additional advantages are provided through the use of embodiments of a hands-free bag carrying device as disclosed herein. In an exemplary embodiment a hands-free bag carrying device includes a contoured saddle. The contoured saddle includes a base with a front panel attached to the base, a back panel attached to the base and a plurality of hooks attached to the base. The hands-free bag carrying device further includes a strap attachable to the contoured saddle. Such a device facilitates the transport of baggage while freeing up a traveler's hands. The device will not interfere with the normal walking pace or walking manner of the user by optimally leveraging the load and preventing the baggage from rubbing against the legs of the user. The hands-free device maintains a comfortable feel during periods of extended use.

Other details of the Resin Transfer Molding process are set forth in the following detailed description and the accompanying drawing wherein like reference numerals depict like elements.

DETAILED DESCRIPTION

The present disclosure pertains to a hands-free bag carrying device. The device disclosed herein in an exemplary embodiment has a strap which hangs over or attaches to the shoulder opposite the side of the weight and allows for optimal balancing of the weight and minimal interference with the comfortable and normal pace of walking. The strap is attached to a contoured saddle which fits comfortably along the torso proximate the ribs of the user and hugs the front side and backside of the torso. A plurality of spring loaded or otherwise biased hooks are disposed towards the center of the saddle, at an elevated point on the saddle. The hooks are used as attachment points for multiple bags, umbrellas, jackets and similar articles. The position of the hooks on an elevated portion of the saddle, helps to avoid rubbing the load attached on the hooks against the user's legs during transportation.

Figure 1:
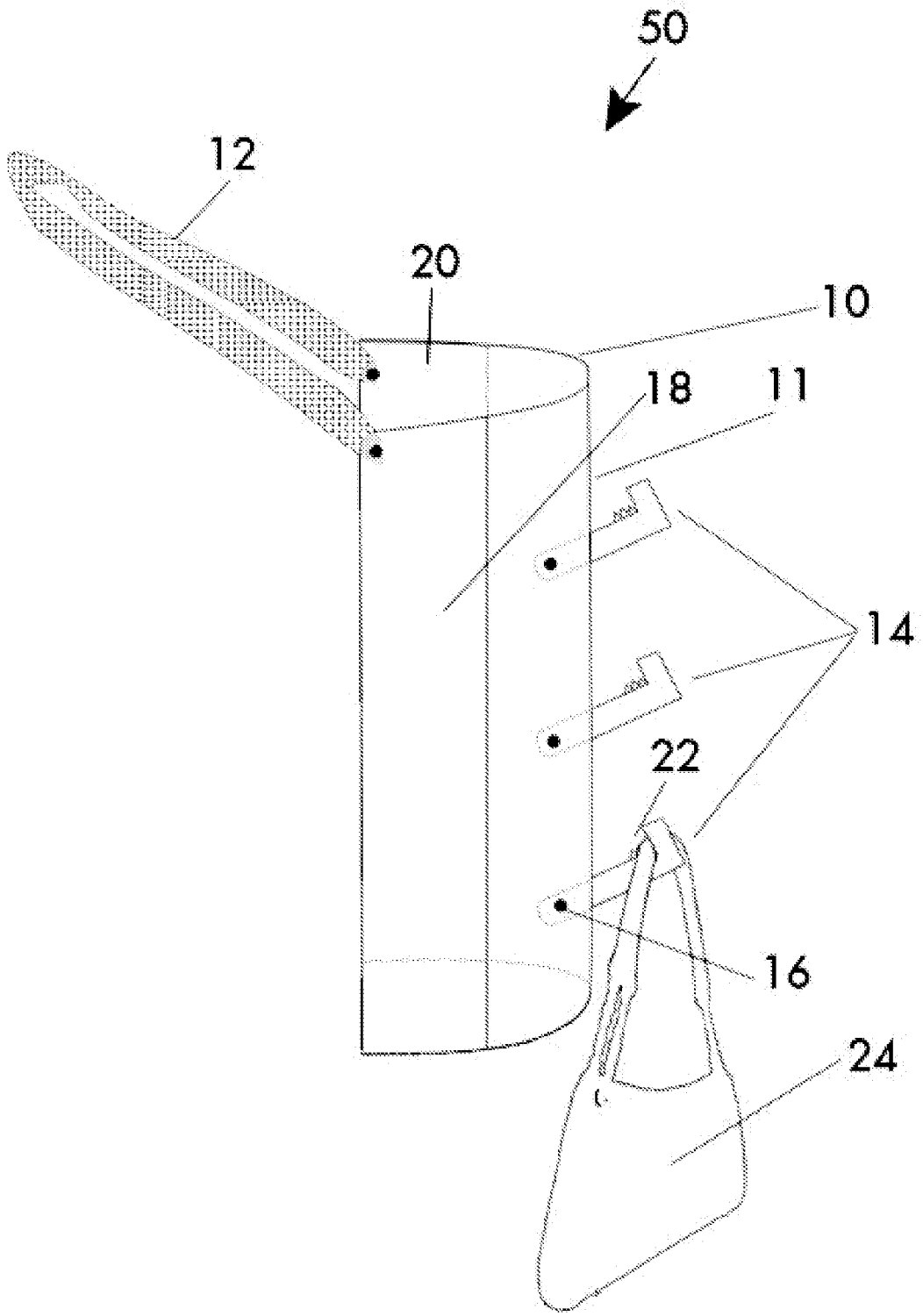
FIG. 1 illustrates an exemplary hands-free bag carrying device.
Figure 2:
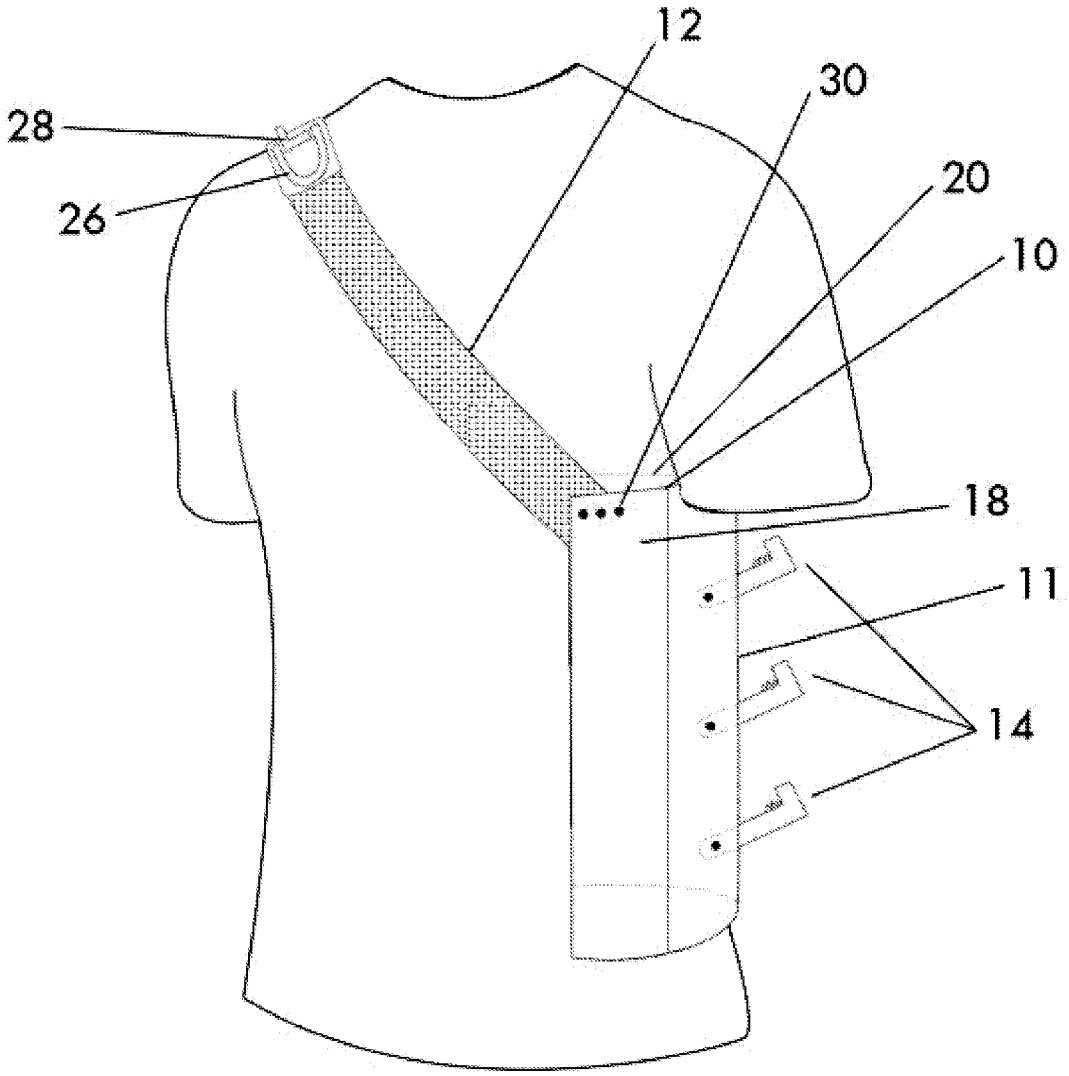
FIG. 2 illustrates an exemplary hands-free bag carrying device worn about a user.

Referring to FIG. 1 and FIG. 2, a hands-free bag carrying device 50 in an exemplary embodiment, is disclosed herein. The device 50 includes a strap 12 attached to a contoured saddle 10. The contoured saddle 10 is configured as an integral panel or sheet having a curved non-linear shape. The saddle 10 has a base 11, a front panel 18 attached to the base 11. The front panel 18 is configured to closely fit to or hug a front torso side-section of a user or wearer. A back panel 20 is attached to the base 11. The back panel 20 is configured to closely fit or hug a back portion of the torso at the side-section of the wearer.

In an exemplary embodiment, the saddle 10 is configured in a single piece and manufactured as one piece. In this embodiment the saddle 10 includes the base 11 which is curved in front and the front panel 18 and the back panel 20 are straight and substantially linear. The saddle in this embodiment, forms a U shaped assembly, such that the cross section has a curved shape, similar to a U. The saddle can be formed by molding, adhesive or thermoplastic joining and the like.

In another exemplary embodiment the front panel 18 and the back panel 20 are thinner than the base 11 to allow a more flexible fit to the contour of different size users. The front torso side is the anterior side or the side that corresponds with the chest of the user. The back torso side is the posterior side or the side that corresponds with back of the user. The base 11 is centrally located in relation to the front panel 18 and back panel 20. The base 11 is also elevated in relation to the front panel 18 and the back panel 20. The elevation of the base 11 is designed to allow the base to protrude further away from the user's body. This feature carries the articles clear of the user's legs for easier interference free motion.

Towards the center of the base 11, a plurality of hooks 14 are disposed at an elevated point on the base 11. In an exemplary embodiment, at least one of the plurality of hooks 14 is a spring loaded hook which is attached to spring 16. The hooks 14 are configured to collapse into the side of the base 11 due to the spring 16 bias. The hooks 14 collapse into the base 11 when the force of the spring 16 is greater than an article 24 hanging on the hook 14 or in the absence of an article 24. The spring bias of the spring 16 provides resistance that enables the hooks 14 to securely hold bag straps, clinch umbrellas and jackets which are laid across the hooks 14. The hooks 14 also can have teeth like protrusions 22, which allow for better gripping to hold a baggage item or article 24. Exemplary hooks 14 include, but are not limited to, inverted spring clips or carabineers.

Referring to FIG. 2, a contoured saddle 10 is shown comfortably hugging the torso of the wearer. In one embodiment, the strap 12 has a shoulder pad 26 to cushion the load and an "L" shaped tab 28 which prevents the strap 12 from sliding off a user's shoulder. The "L" shaped tab 28 allows a person to carry an additional bag with a strap on the shoulder opposite the saddle 10. In an exemplary embodiment, the "L" shaped tab is a small plastic feature attached to the shoulder strap that prevents an extra bag (not shown) from sliding off the opposite shoulder. For example, a person may have an umbrella and lunch bag on attached to the saddle 10 at hooks 14 and may carry a pocketbook on the other shoulder and the "L" tab will prevent the pocketbook from sliding off the opposite shoulder. The strap 12 can attach to a plurality of attachment points 30 which lie across the top edge of the front panel 18 and the back panel 20. These attachment points 30 allow for adjustment of the fit of the saddle 10 to accommodate the variance in sizes of different people. The length of the shoulder strap 12 is also adjustable to allow persons of different heights to adjust the device 10 for best fit. FIG. 2 also shows how the device is worn around the opposite shoulder to the load. Hence, if the load is on the right hand side, then the strap 12 is on the left hand side shoulder and vice versa. This configuration allows the saddle 10 to fit firmly along the torso to comfortably hug the side of the user. This configuration also allows the load on the hooks 14 to be comfortably leveraged, so that the load minimally interferes with the normal walking pattern of the user.

In an exemplary embodiment, the internal structure of the saddle 10, including the front panel 18 and the back panel 20 is comprised of a hard plastic or a composite material. The front panel 18 and the back panel 20 may include hard foam for comfort. In another embodiment, the hard foam is a closed cell foam (e.g., an EVA foam) and provides a shock absorbing cushion. The saddle 11 may also be covered with a canvas fabric (not shown). The hooks 14 can be a plastic or a composite material.

Figure 3:
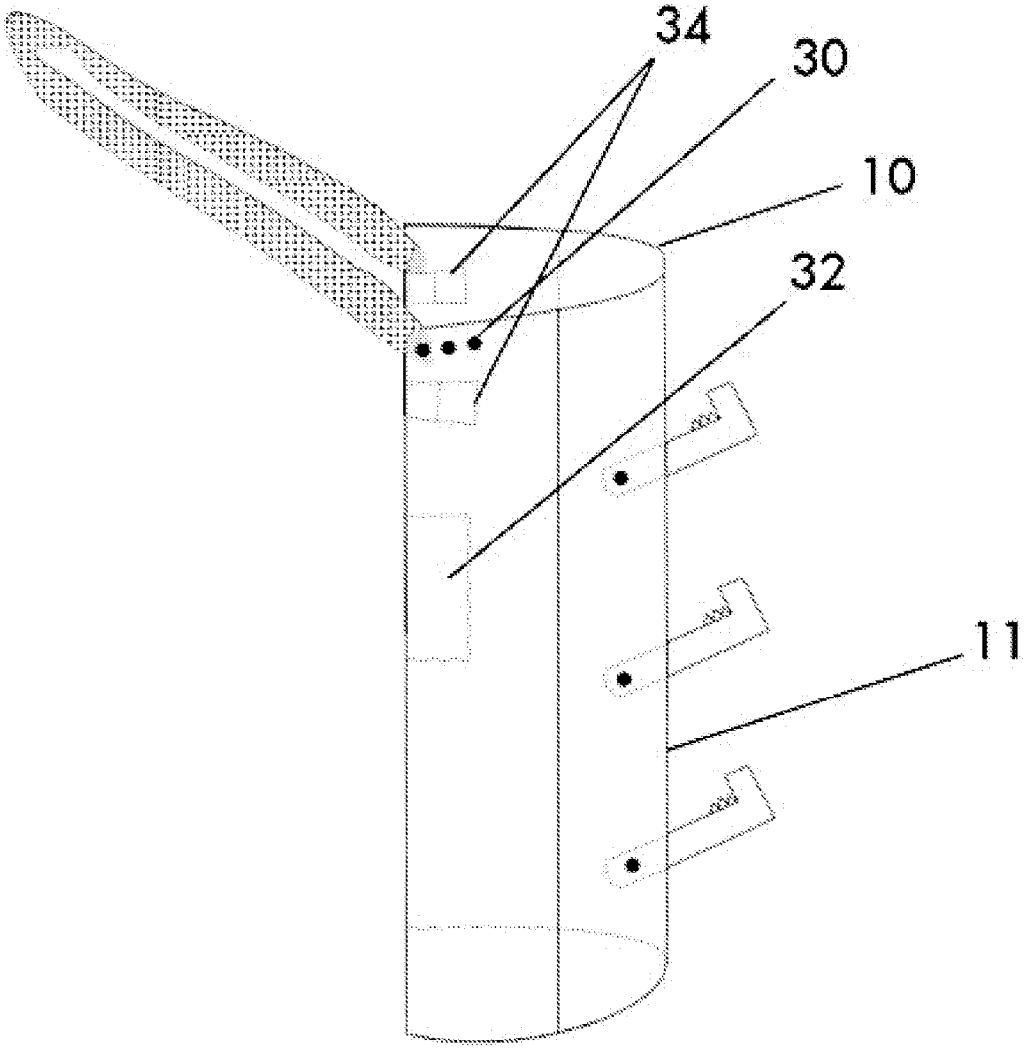
FIG. 3 illustrates an exemplary device with additional features configured to secure baggage.

Referring to FIG. 3, in an exemplary embodiment, the saddle 10 has one or more clamps 32 attached to the inside of the panels which are used to attach to the strap of a bag (e.g., a separate messenger bag). The clamps allow a user to remove strap 12 and then clamp the saddle 10 to a messenger bag strap. In an exemplary embodiment, the front panel 18 has a clamp 32 to connect to the messenger bag strap in front of the body to the saddle 10 and a back panel clamp 32 to connect the messenger bag strap going across the back of the body to the saddle 10. Now the user can carry more items on hooks of hands-free bag carrying device 50. The saddle 10 can also have metal barrettes 34 embedded on the inside of the front panel 18 or the back panel 20. When the barrette is closed, the teeth of the barrette grip and secure the strap of a bag to the device. In another embodiment, the metal barrette 34 has one or more studs which fit securely into attachment points 30 on the front panel 18 or the back panel 20.

Figure 4:
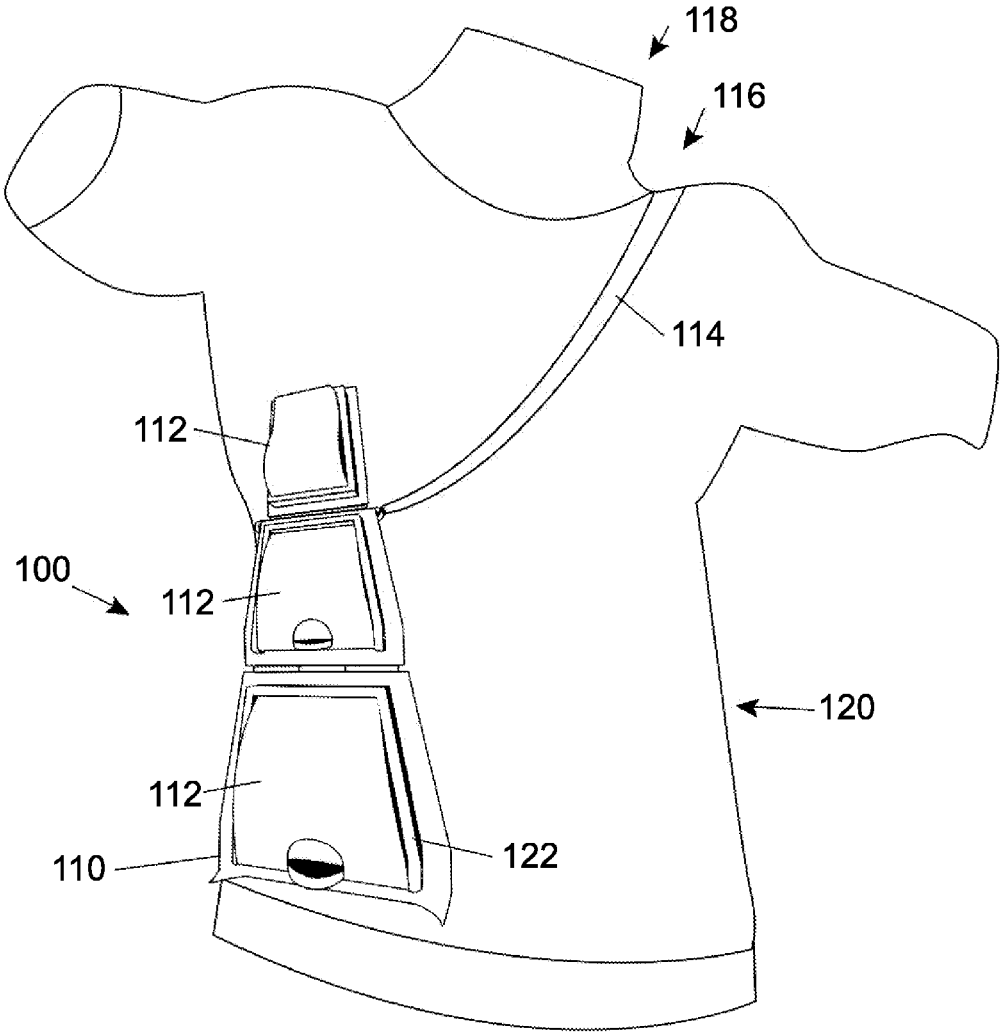
FIG. 4 illustrates another exemplary device worn on a user.
Figure 5:
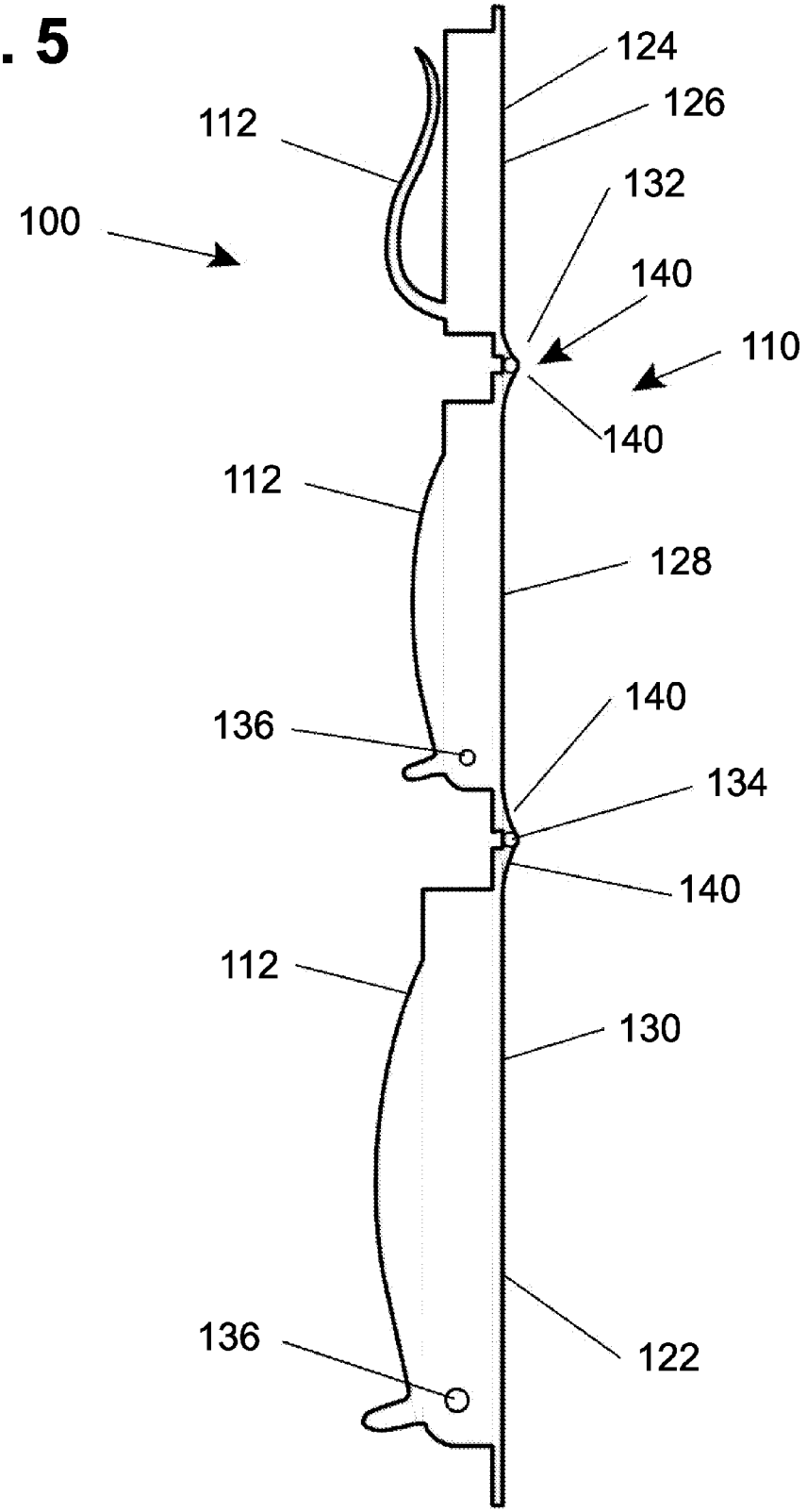
FIG. 5 illustrates a side view of an exemplary device.
Figure 6:
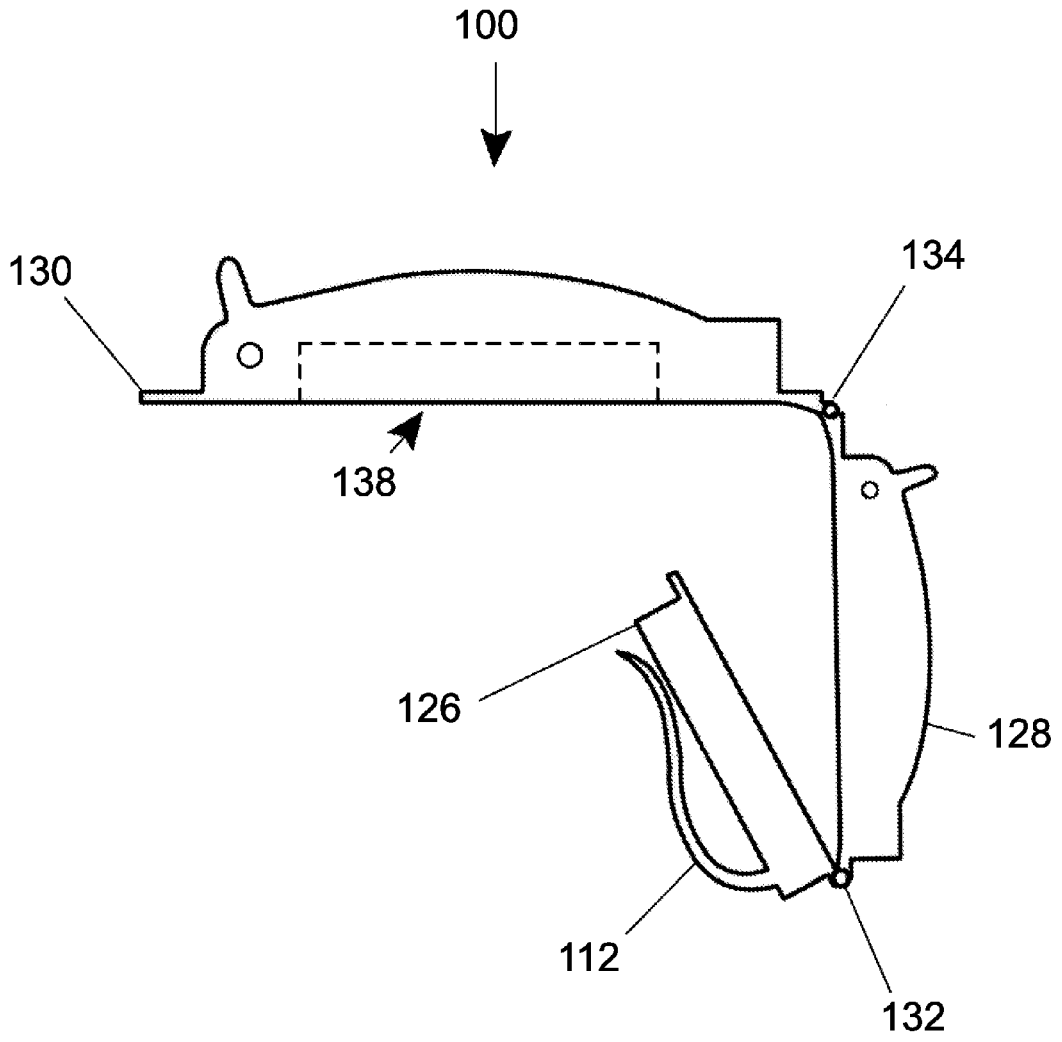
FIG. 6 illustrates a side view of an exemplary device being partially folded.

Referring to FIGS. 4, 5 and 6 an exemplary embodiment of the device 100 is shown. The device 100 includes similar features to the embodiments shown above. The device 100 includes the saddle 110 having a plurality of hooks 112. The saddle 110 includes a strap 114, configured to support the device 100 and fit over a shoulder 116 of the user 118 opposite the side of the user's torso 120 were the device 100 is located, as described in greater detail above. The saddle 110 is configured with a base 122 that is formed from an integral panel or multiple panels 124 as shown. A first panel 126, second panel 128 and third panel 130 are shown. It is contemplated that more or less panels 124 can be deployed as needed. The panels 124 are formed of a rigid to semi-rigid material in a sheet, or combination of sheets. The panels 124 provide structural support both in a compressive load, and in tension in all directions.

The multiple panels 124 are coupled by a first hinge 132 and second hinge 134. The first and second hinges 132, 134 are configured to facilitate each of the panels 124 to rotate and fold onto one another as shown in part at FIG. 6. The second hinge 134 couples the second panel 128 with the third panel 130. The hinges 132, 134 couple the panels 126, 128, 130 at a location where the panels 126, 128, 130 are adjacent, such as along an edge or perimeter 140. Hinged panels 124 allows for the device 100 to become more compact. The device 100 is also more flexible and allows for the user to bend and twist the torso 120 with greater ease. The hinges 132, 134 allow for relative movement between the panels 126, 128, 130.

The panels 126, 128, 130 are shown with varying sizes. The first panel 126 is smaller than the second panel 128 which is smaller than the third panel 130. The size variation allows for a greater range of motion by the user, lighter weight overall, a variety in hook 112 sizes. It is contemplated that the panels 126, 128, 130 can be similar in size as well as vary sizes.

In the exemplary embodiment shown at FIGS. 4, 5 and 6, the hooks 112 include a spring or biasing member 136. Also, the first panel 126 includes a hook 112 that is self-biasing without an extra spring, the shape of the hook 112 that curves back onto itself and flexes provides the spring bias.

As with the embodiments shown and described relative to FIGS. 1-3, the saddle 110 formed from the integral panel has no framework, tubing, or the like to provide support. The integral panel 124 provides the necessary structural integrity to support the strap 114, and hooks 112 along with any articles supported thereby.

The third panel 130, as shown in FIG. 6, includes a cavity portion 138 that is configured to receive the hook 112 of the first panel 126. The cavity 138 allows for the hook 112 to stow away and thus lowers the profile of the device 100 when it is folded.

The hands-free carry device 50, 100 allows for an integrally formed saddle with hooks and strap a convenient carrying technique without the use of the hands. There are no internal tube frames or extraneous webbing. The device 50, 100 can be worn comfortably along either side of the torso of the user such that any articles suspended from the device 50, 100 can be carried and not interfere with walking or the use of the hands.

There has been provided a hands-free bag carrying device. While the hands-free bag carrying device has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A system for carrying articles, such as bags comprising:

a saddle comprising a base configured as at least one integral panel, each said at least one panel comprising an integrally formed sheet of rigid material;

at least one spring biased hook is coupled to at least one panel, said at least one spring biased hook configured to support said article attached thereto; and a strap coupled to said base, said strap being configured to support the saddle and fit over a shoulder of a user, said shoulder being opposite a side of the user's torso proximate said saddle.

2. The system according to claim 1, wherein said at least one integral panel comprises a plurality of panels rotatably coupled to each other.

3. The system according to claim 2, wherein said plurality of panels are hinged together and configured to fold onto each other such that at least one hook stows into at least one cavity.

4. The system according to claim 1, wherein said strap comprises a tab configured to support a strap of another bag proximate said shoulder of said user.

5. The system according to claim 1, wherein said base is configured in a curved shape to elevate distally from said torso of said user, and configured to provide a clearance space away from a user's legs with relation to an article suspended from said base.

6. The system according to claim 1, at least one clamp attached to the at least one panel; the at least one clamp configured to attach said saddle to a strap of a separate bag.

7. A system for carrying articles, such as bags comprising:

a saddle comprising a base configured as at least one integral panel, each said at least one panel comprising an integrally formed sheet of rigid material, at least one integral panel including at least one cavity formed in said integral panel; wherein said at least one integral panel comprises a plurality of panels rotatably coupled to each other configured to fold onto each other;

at least one biased hook is coupled to at least one panel, wherein said at least one cavity formed in said integral panel is configured to receive another hook of another panel; such that said another hook stows away into said cavity and lowers a profile of said system; and a strap coupled to said base, said strap being configured to support the saddle and fit over a shoulder of a user, said shoulder being opposite a side of the user's torso proximate said saddle.

* * * * *